US010605267B2

(12) United States Patent
Hino et al.

(10) Patent No.: US 10,605,267 B2
(45) Date of Patent: Mar. 31, 2020

(54) BLOWER APPARATUS

(71) Applicant: Nidec Corporation, Kyoto (JP)

(72) Inventors: Yuko Hino, Kyoto (JP); Seung-Sin Yoo, Kyoto (JP); Tomoyuki Tsukamoto, Kyoto (JP); Akihiko Makita, Kyoto (JP)

(73) Assignee: NIDEC CORPORATION, Kyoto-shi (JP)

( * ) Notice: Subject to any disclaimer, the term of this patent is extended or adjusted under 35 U.S.C. 154(b) by 309 days.

(21) Appl. No.: 15/615,316

(22) Filed: Jun. 6, 2017

(65) Prior Publication Data

US 2017/0356467 A1 Dec. 14, 2017

Related U.S. Application Data

(60) Provisional application No. 62/347,380, filed on Jun. 8, 2016.

(30) Foreign Application Priority Data

Mar. 15, 2017 (JP) ..... 2017-049390

(51) Int. Cl.
*F04D 29/62* (2006.01)
*F04D 17/16* (2006.01)
(Continued)

(52) U.S. Cl.
CPC ..... *F04D 29/626* (2013.01); *F04B 35/04* (2013.01); *F04D 17/161* (2013.01); *F04D 25/06* (2013.01);
(Continued)

(58) Field of Classification Search
CPC .. F04D 29/626; F04D 25/0613; F04D 17/161; F04D 29/083; F04D 25/06; F04B 35/04; F04B 17/00
See application file for complete search history.

(56) References Cited

U.S. PATENT DOCUMENTS 9,846,462 B2 12/2017 Chen et al.
2005/0169743 A1 8/2005 Hicks
(Continued)

FOREIGN PATENT DOCUMENTS

CN 105022460 A 11/2015
JP 2008-88985 A 4/2008

OTHER PUBLICATIONS

Related co-pending U.S. Appl. No. 15/608,270, filed May 30, 2017, counterpart Japanese Patent Application No. 2017-049380.
(Continued)

*Primary Examiner* — Joseph J Dallo
*Assistant Examiner* — Kurt Philip Liethen
(74) *Attorney, Agent, or Firm* — Westerman, Hattori, Daniels & Adrian, LLP

(57) ABSTRACT

This blower apparatus includes an air blowing portion including a plurality of flat plates arranged with an axial gap defined between adjacent ones of the flat plates; a motor portion arranged to rotate the air blowing portion; a clamper portion fixed to the motor portion; and a housing arranged to house the air blowing portion and the motor portion. The housing includes an air inlet and an air outlet. The air blowing portion is held by the motor portion and the clamper portion from upper and lower sides in the axial direction. Once the air blowing portion starts rotating, an air flow traveling radially outward is generated between the flat plates by viscous drag of surfaces of the flat plates and a centrifugal force.

10 Claims, 10 Drawing Sheets

(51) Int. Cl.

| | |
|---|---|
| ***F04D 25/06*** | (2006.01) |
| ***F04B 35/04*** | (2006.01) |
| ***F04D 29/08*** | (2006.01) |
| ***F04B 17/00*** | (2006.01) |

(52) U.S. Cl.
CPC ..... *F04D 25/0613* (2013.01); *F04D 29/083* (2013.01); *F04B 17/00* (2013.01)

(56) References Cited

U.S. PATENT DOCUMENTS

| | | | | |
|---|---|---|---|---|
| 2011/0149511 | A1* | 6/2011 | Zhang | F04D 29/4226 361/695 |
| 2012/0156063 | A1* | 6/2012 | Horng | F04D 17/04 417/321 |
| 2013/0004114 | A1* | 1/2013 | Hasegawa | F04D 17/16 384/607 |
| 2013/0323093 | A1* | 12/2013 | Tamaoka | F04D 25/0613 417/354 |
| 2015/0198176 | A1* | 7/2015 | Tamaoka | F04D 29/5853 361/679.49 |
| 2016/0003261 | A1* | 1/2016 | Tamaoka | F04D 25/0613 415/177 |
| 2018/0209432 | A1* | 7/2018 | Lee | F04D 29/441 |

OTHER PUBLICATIONS

Related co-pending U.S. Appl. No. 15/608,321, filed May 30, 2017, counterpart Japanese Patent Application No. 2017-049381.
Related co-pending U.S. Appl. No. 15/615,115, filed Jun. 6, 2017, counterpart Japanese Patent Application No. 2017-049382.
Related co-pending U.S. Appl. No. 15/608,366, filed May 30, 2017, counterpart Japanese Patent Application No. 2017-049383.
Related co-pending U.S. Appl. No. 15/608,446, filed May 30, 2017, counterpart Japanese Patent Application No. 2017-049384.
Related co-pending U.S. Appl. No. 15/608,482, filed May 30, 2017, counterpart Japanese Patent Application No. 2017-049385.
Related co-pending U.S. Appl. No. 15/615,143, filed Jun. 6, 2017, counterpart Japanese Patent Application No. 2017-049386.
Related co-pending U.S. Appl. No. 15/615,202, filed Jun. 6, 2017, counterpart Japanese Patent Application No. 2017-049387.
Related co-pending U.S. Appl. No. 15/615,234, filed Jun. 6, 2017, counterpart Japanese Patent Application No. 2017-049388.
Related co-pending U.S. Appl. No. 15/615,279, filed Jun. 6, 2017, counterpart Japanese Patent Application No. 2017-049389.
Office Action dated Oct. 31, 2018, issued in counterpart Chinese application No. 201710418676.6, with English translation. (13 pages).

* cited by examiner

BLOWER APPARATUS

BACKGROUND OF THE INVENTION

1. Field of the Invention

The present invention relates to a blower apparatus.

2. Description of the Related Art

A centrifugal blower apparatus which generates an air flow traveling radially outward by rotating an impeller including a plurality of blades is known. A known blower apparatus including an impeller is described in, for example, JP-A 2008-88985.

In the blower apparatus described in JP-A 2008-88985, a plurality of blades referred to as fan blades push surrounding gas to generate air flows traveling radially outward.

SUMMARY OF THE INVENTION

In recent years, there has still been a demand for reductions in the size and thickness of electronic devices. Accordingly, there has also been a demand for a reduction in the thickness of blower apparatuses used to cool the interiors of the electronic devices.

Here, in the case where an impeller is used to generate air flows, as in the blower apparatus described in JP-A 2008-88985, air flows pushed by a blade leak from axially upper and lower ends of the blade while the impeller is rotating. As a result, air pressure is lower at the axially upper and lower ends of the blade than in the vicinity of an axial middle of the blade. Accordingly, a reduction in the thickness of the blower apparatus, which involves a reduction in the axial dimension of the impeller, will result in a failure to secure sufficient air blowing efficiency.

An object of the present invention is to provide a technique for realizing a centrifugal blower apparatus which is excellent in air blowing efficiency.

A blower apparatus according to a preferred embodiment of the present invention includes an air blowing portion arranged to rotate about a central axis extending in a vertical direction; a motor portion arranged to rotate the air blowing portion, and having at least a portion thereof arranged on a lower side of the air blowing portion; a clamper portion fixed to the motor portion, and having at least a portion thereof arranged on an upper side of the air blowing portion; and a housing arranged to house the air blowing portion and the motor portion. The housing includes an air inlet arranged above the air blowing portion, and arranged to pass through a portion of the housing in an axial direction; and an air outlet arranged to face in a radial direction at at least one circumferential position radially outside of the air blowing portion. The air blowing portion includes a plurality of flat plates arranged in the axial direction with an axial gap defined between adjacent ones of the flat plates. The air blowing portion is held by the motor portion and the clamper portion from upper and lower sides in the axial direction.

According to the above preferred embodiment of the present invention, once the air blowing portion starts rotating, an air flow traveling radially outward is generated in the axial gap between the adjacent ones of the flat plates by viscous drag of surfaces of the flat plates and a centrifugal force. Thus, gas supplied through the air inlet and an air hole travels radially outwardly of the air blowing portion. Since the air flow is generated between the flat plates, the air flow does not easily leak upwardly or downwardly, and thus, an improvement in air blowing efficiency is achieved. Accordingly, a reduced thickness of the blower apparatus according to the above preferred embodiment of the present invention does not result in a significant reduction in the air blowing efficiency. In addition, the blower apparatus according to the above preferred embodiment of the present invention is superior to a comparable centrifugal fan including an impeller in terms of being silent. Further, since the air blowing portion and the motor portion are securely fixed to each other by the clamper portion, the air blowing portion is able to stably rotate. This leads to an improvement in the air blowing efficiency and an additional reduction in noise.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, blower apparatuses according to preferred embodiments of the present invention will be described. It is assumed herein that a side on which an upper plate portion is arranged with respect to a lower plate portion is an upper side, and the shape of each member or portion and relative positions of different members or portions will be described based on the above assumption. It should be noted, however, that the above definition of the upper and lower sides is not meant to restrict in any way the orientation of a blower apparatus according to any preferred embodiment of the present invention at the time of manufacture or when in use.

1. First Preferred Embodiment

Figure 1:
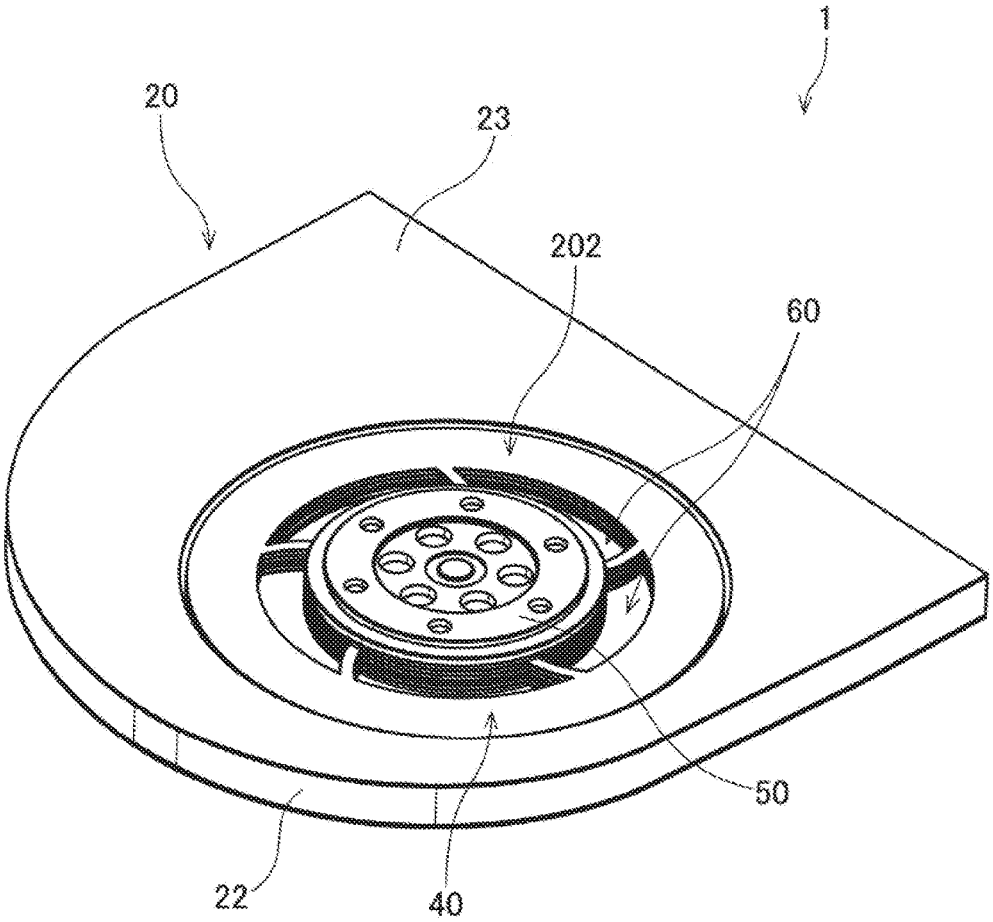
FIG. 1 is a perspective view of a blower apparatus according to a first preferred embodiment of the present invention.
Figure 2:
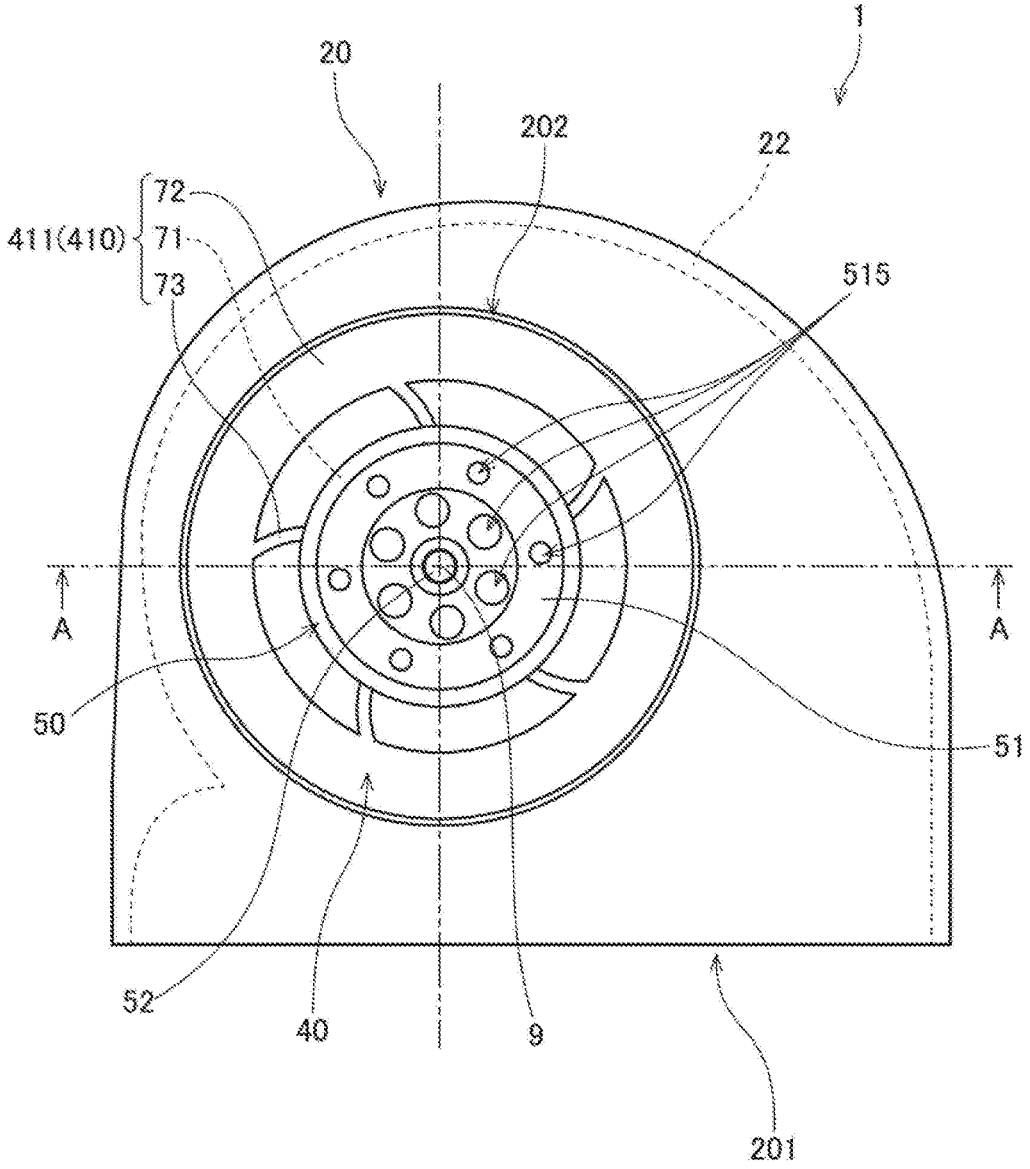
FIG. 2 is a top view of the blower apparatus according to the first preferred embodiment.
Figure 3:
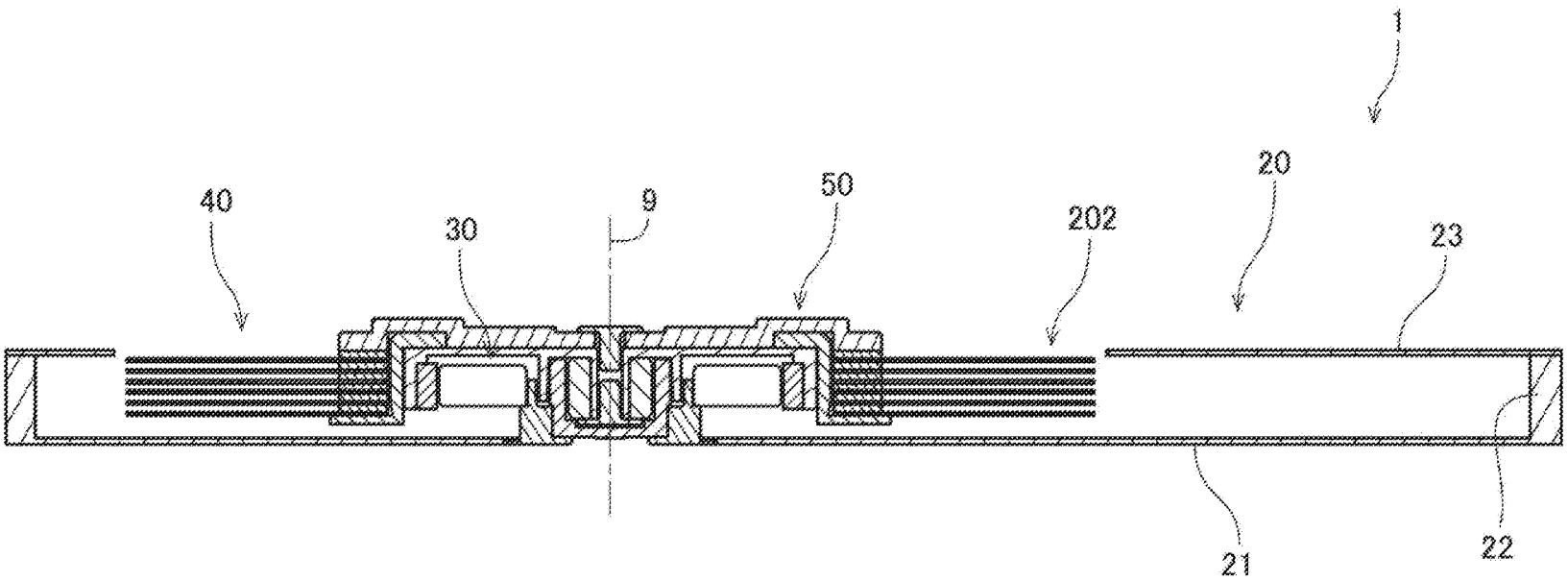
FIG. 3 is a sectional view of the blower apparatus according to the first preferred embodiment.
Figure 4:
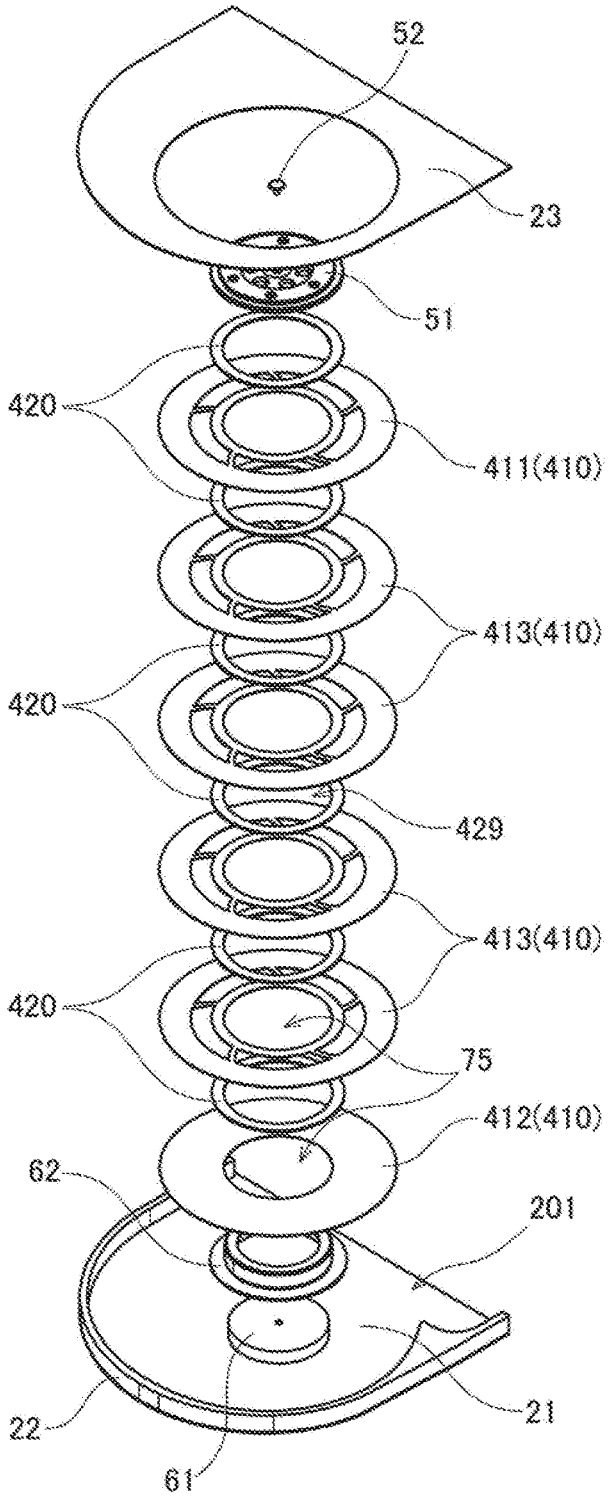
FIG. 4 is an exploded perspective view of the blower apparatus according to the first preferred embodiment.
Figure 5:
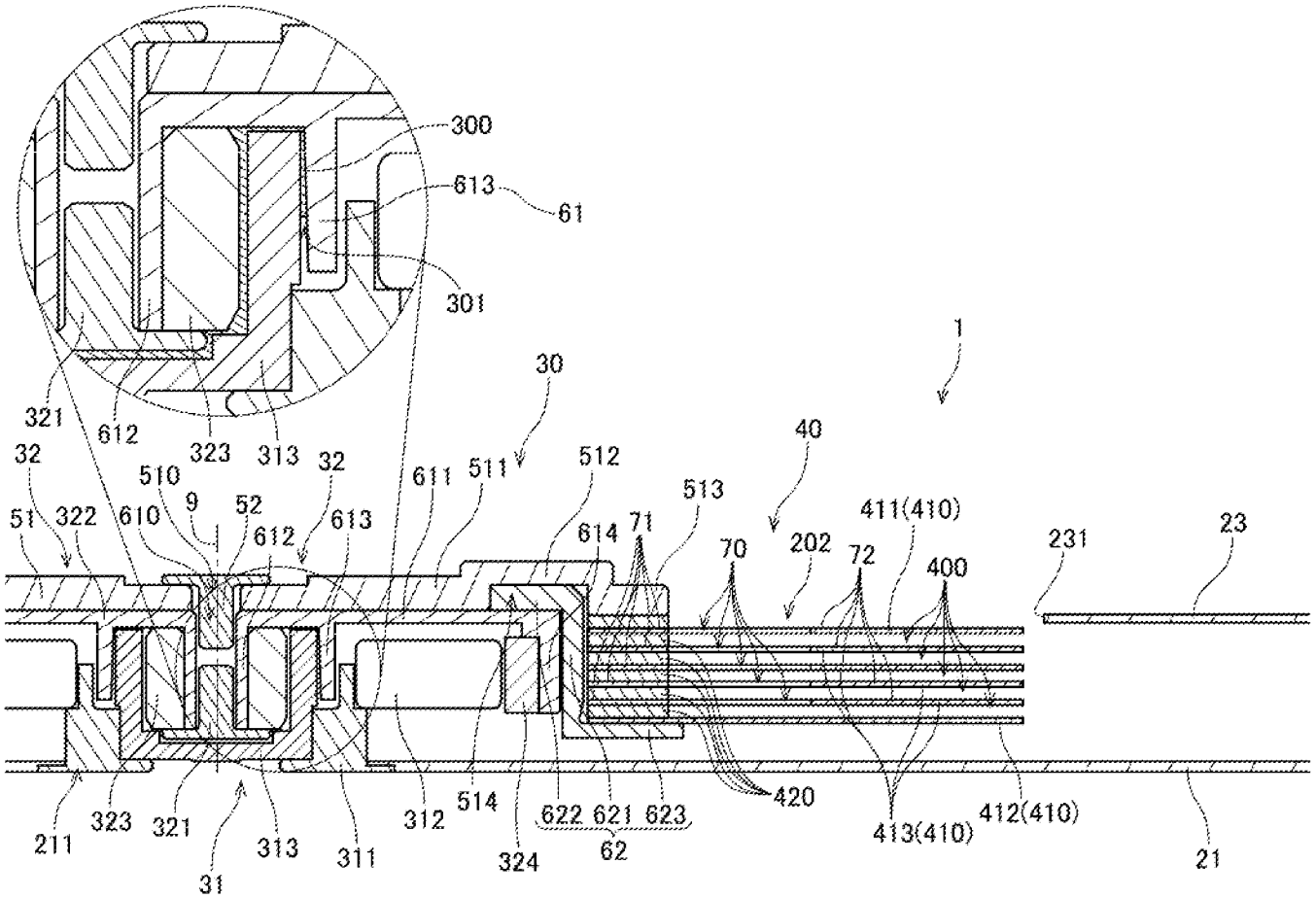
FIG. 5 is a partial sectional view of the blower apparatus according to the first preferred embodiment.

FIG. 1 is a perspective view of a blower apparatus 1 according to a first, preferred embodiment of the present invention. FIG. 2 is a top view of the blower apparatus 1. FIG. 3 is a sectional view of the blower apparatus 1 taken along line A-A in FIG. 2. FIG. 4 is an exploded perspective view of the blower apparatus 1. FIG. 5 is a partial sectional view of the blower apparatus 1. The blower apparatus 1 is a centrifugal blower apparatus designed to generate an air flow traveling radially outward by rotating an air blowing portion 40. The blower apparatus 1 is, for example, installed in an electronic device, such as, for example, a personal computer, to cool an interior thereof. Note that the blower apparatus 1 according to a preferred embodiment of the present invention may alternatively be used for other purposes.

Referring to FIGS. 1 to 4, the blower apparatus 1 includes a housing 20, a motor portion 30, the air blowing portion 40, and a clamper portion 50.

The housing 20 is a case arranged to house the motor portion 30 and the air blowing portion 40. The housing 20 includes a lower plate portion 21, a side wall portion 22, and an upper plate portion 23.

The lower plate portion 21 is arranged to define a bottom portion of the housing 20. The lower plate portion 21 is arranged to extend radially below the air blowing portion 40 to cover at least a portion of a lower side of the air blowing portion 40. In addition, the lower plate portion 21 is arranged to support the motor portion 30.

The side wall portion 22 is arranged to extend upward from the lower plate portion 21. The side wall portion 22 is arranged to cover a lateral side of the air blowing portion 40 between the lower plate portion 21 and the upper plate portion 23. In addition, the side wall portion 22 includes an air outlet 201 arranged to face in a radial direction at one circumferential position. In the present preferred embodiment, the lower plate portion 21 and the side wall portion 22 are defined integrally with each other. Note that the lower plate portion 21 and the side wall portion 22 may alternatively be defined by separate members.

The upper plate portion 23 is arranged to define a cover portion of the housing 20. The upper plate portion 23 is arranged to extend radially above the lower plate portion 21. In addition, the upper plate portion 23 includes an air inlet 202 arranged to pass therethrough in an axial direction. In other words, the upper plate portion 23 includes an inner edge portion 231 arranged to define the air inlet 202. The air inlet 202 is, for example, circular and is centered on a central axis 9 in a plan view.

The motor portion 30 is a driving portion arranged to rotate the air blowing portion 40. Referring to FIG. 5, the motor portion 30 includes a stationary portion 31 and a rotating portion 32. The stationary portion 31 is fixed to the lower plate portion 21. The stationary portion 31 is thus arranged to be stationary relative to the housing 20. The rotating portion 32 is supported to be rotatable about the central axis 9 with respect to the stationary portion 31.

The stationary portion 31 includes a stator fixing portion 311, a stator 312, and a bearing housing 313.

The stator fixing portion 311 is fitted in a fixing hole 211 defined in the lower plate portion 21. As a result, the stator fixing portion 311 is fixed to the lower plate portion 21. The stator fixing portion 311 is arranged to extend upward from the fixing hole 211 to assume a cylindrical shape with the central axis 9 as a center thereof. The stator 312 is fixed to an outer circumferential portion of an upper portion of the stator fixing portion 311.

The stator 312 is an armature arranged to generate magnetic flux in accordance with electric drive currents supplied from an external source. The stator 312 is arranged to annularly surround the central axis 9, which extends in a vertical direction. The stator 312 includes, for example, an annular stator core defined by laminated steel sheets, and conducting wires wound around the stator core.

The bearing housing 313 is a member being cylindrical and having a closed bottom. Specifically, the bearing housing 313 includes a disk-shaped bottom portion, and a cylindrical portion arranged to extend upward from the bottom portion. The bearing housing 313 is fixed to an inner circumferential surface of the stator fixing portion 311.

The rotating portion 32 includes a shaft 321, a hub 322, a bearing member 323, and a magnet 324.

The shaft 321 is a member arranged to extend along the central axis 9. The shaft 321 according to the present preferred embodiment includes a columnar portion arranged inside of a first cylindrical portion 612, which will be described below, and arranged to extend with the central axis 9 as a center thereof, and a disk-shaped portion arranged to extend radially from a lower end portion of the columnar portion.

The hub 322 is fixed to the shaft 321. The hub 322 is made up of a hub body member 61 and a flange member 62.

The hub body member 61 includes a first top plate portion 611, the first cylindrical portion 612, a second cylindrical portion 613, and a magnet holding portion 614.

The first top plate portion 611 is a disk-shaped portion arranged to extend radially with the central axis 9 as a center thereof. The first top plate portion 611 is arranged above the stator 312. The first top plate portion 611 has a fixing hole 610 arranged to pass therethrough in the vertical direction in a center thereof.

The first cylindrical portion 612 is arranged to extend downward from an inner edge portion of the first top plate portion 611 which defines the fixing hole 610 to assume a cylindrical shape with the central axis 9 as a center thereof. The columnar portion of the shaft 321 is housed in the first cylindrical portion 612. In addition, the shaft 321 is fixed to the first cylindrical portion 612.

The second cylindrical portion 613 is arranged to extend downward from the first top plate portion 611 to assume a cylindrical shape with the central axis 9 as a center thereof. The second cylindrical portion 613 is arranged to have an inside diameter greater than an outside diameter of the first cylindrical portion 612. In other words, the second cylindrical portion 613 is arranged radially outside of the first cylindrical portion 612.

The magnet holding portion 614 is arranged to extend downward from a radially outer end of the first top plate portion 611 to assume a cylindrical shape with the central axis 9 as a center thereof. The magnet holding portion 614 is arranged radially outside of the stator 312. The magnet 324 is fixed to an inner circumferential surface of the magnet holding portion 614.

The flange member 62 includes an outer wall portion 621, a second top plate portion 622, and a flat plate holding portion 623.

The outer wall portion 621 is a cylindrical portion arranged to extend in the vertical direction with the central axis 9 as a center thereof. The outer wall portion 621 is arranged to extend along an outer circumferential surface of the magnet holding portion 614 of the hub body member 61.

The second top plate portion 622 is arranged to extend radially inward from an upper end portion of the outer wall portion 621 to assume the shape of a circular ring. The second top plate portion 622 is arranged on an upper surface of the first top plate portion 611 of the hub body member 61. The second top plate portion 622 is thus arranged to cover a portion of an upper surface of the hub body member 61.

The flat plate holding portion 623 is arranged to extend radially outward from a lower end portion of the outer wall portion 621. The flat plate holding portion 623 is arranged to hold the air blowing portion 40 on a radially outer side of the magnet holding portion 614 of the hub body member 61. In the present, preferred embodiment, the air blowing portion 40 is mounted on an upper surface of the flat plate holding portion 623. The flat plate holding portion 623 is thus arranged to hold a plurality of flat plates 410 included in the air blowing portion 40.

The bearing member 323 is a cylindrical member arranged to extend in the vertical direction with the central axis 3 as a center thereof. The bearing member 323 is arranged to extend along an outer circumferential surface of the first cylindrical portion 612 of the hub body member 61. In addition, the bearing member 323 is fixed to the outer circumferential surface of the first cylindrical portion 612. The cylindrical portion of the bearing housing 313 is arranged radially outside of the bearing member 323 and radially inside of the second cylindrical portion 613 of the hub body member 61.

The magnet 324 is fixed to the inner circumferential surface of the magnet holding portion 614 of the hub body member 61. In addition, the magnet 324 is arranged radially outside of the stator 312. The magnet 324 according to the present preferred embodiment is in the shape of a circular ring. A radially inner surface of the magnet 324 is arranged radially opposite to the stator 312 with a slight gap therebetween. In addition, an inner circumferential surface of the magnet 324 includes north and south poles arranged to alternate with each other in a circumferential direction. Note that a plurality of magnets may be used in place of the magnet 324 in the shape of a circular ring. In the case where the plurality of magnets are used, the magnets are arranged in the circumferential direction such that north and south poles of the magnets alternate with each other.

As illustrated in an enlarged view in FIG. 5, a lubricating fluid 300 is arranged between the bearing housing 313 and a combination of the shaft 321, the bearing member 323, and the hub body member 61. A polyolester oil or a diester oil, for example, is used as the lubricating fluid 300. The shaft 321, the hub 322, and the bearing member 323 are supported to be rotatable with respect to the bearing housing 313 through the lubricating fluid 300. Thus, in the present preferred embodiment, the bearing housing 313, which is a component of the stationary portion 31, the combination of the shaft 321, the bearing member 323, and the hub body member 61, each of which is a component of the rotating portion 32, and the lubricating fluid 300 together define a fluid dynamic bearing.

A surface of the lubricating fluid 300 is defined in a seal portion 301, which is a gap between an outer circumferential surface of the bearing housing 313 and an inner circumferential surface of the second cylindrical portion 613 of the hub body member 61. In the seal portion 301, the distance between the outer circumferential surface of the bearing housing 313 and the inner circumferential surface of the second cylindrical portion 613 is arranged to increase with decreasing height. In other words, in the seal portion 301, the distance between the outer circumferential surface of the bearing housing 313 and the inner circumferential surface of the second cylindrical portion 613 is arranged to increase with increasing distance from the surface of the lubricating fluid 300. Since the radial width of the seal portion 301 thus increases with decreasing height, the lubricating fluid 300 is attracted upward in the vicinity of the surface of the lubricating fluid 300. This reduces the likelihood that the lubricating fluid 300 will leak out of the seal portion 301.

Use of the fluid dynamic bearing as a bearing mechanism that connects the stationary portion 31 and the rotating portion 32 allows the rotating portion 32 to rotate stably. Thus, the likelihood of an occurrence of an unusual sound from the motor portion 30 can be reduced.

Once electric drive currents are supplied to the stator 312 in the motor portion 30 as described above, magnetic flux is generated around the stator 312. Then, interaction between the magnetic flux of the stator 312 and magnetic flux of the magnet 324 produces a circumferential torque between the stationary portion 31 and the rotating portion 32, so that the rotating portion 32 is caused to rotate about the central axis 9 with respect to the stationary portion 31. The air blowing portion 40, which is held by the flat plate holding portion 623 of the rotating portion 32, is caused to rotate about the central axis 9 together with the rotating portion 32.

Referring to FIGS. 4 and 5, the air blowing portion 40 includes the plurality of flat plates 410 and a plurality of spacers 420. The flat plates 410 and the spacers 420 are arranged to alternate with each other in the axial direction. In addition, adjacent ones of the flat plates 410 and the spacers 420 are fixed to each other through, for example, adhesion.

Referring to FIGS. 4 and 5, in the present preferred embodiment, the flat plates 410 include a top flat plate 411, which is arranged at the highest position, a bottom flat plate 412, which is arranged at the lowest position, and four intermediate flat plates 413, which are arranged below the top flat plate 411 and above the bottom flat plate 412. That is, the number of flat plates 410 included in the air blowing portion 40 according to the present preferred embodiment is six. The flat plates 410 are arranged in the axial direction with an axial gap 400 defined between adjacent ones of the flat plates 410.

Each flat plate 410 is made of, for example, a metal material, such as stainless steel, or a resin material. Each flat plate 410 may alternatively be made of, for example, paper. In this case, paper including a glass fiber, a metal wire, or the like in addition to plant fibers may be used. The flat plate 410 is able to achieve higher dimensional accuracy when the flat plate 410 is made of a metal material than when the flat plate 410 is made of a resin material.

In the present preferred embodiment, each of the top flat plate 411 and the four intermediate flat plates 413 is arranged to have the same shape and size. Referring to FIGS. 1, 2, and 5, each of the top flat plate 411 and the intermediate flat plates 413 includes an inner annular portion 71, an outer annular portion 72, a plurality of ribs 73, and a plurality of air holes 70. In the present preferred embodiment, the number of ribs 73 and the number of air holes 70 included in each of the top flat plate 411 and the intermediate flat plates 413 are both five.

The inner annular portion 71 is an annular portion centered on the central axis 9. The inner annular portion 71 has a central hole 75 (see FIG. 4) arranged to pass therethrough in the vertical direction in a center thereof. The outer annular portion 72 is an annular portion arranged radially outside of the inner annular portion 71 with the central axis 9 as a center thereof. Each rib 73 is arranged to join the inner annular portion 71 and the outer annular portion 72 to each other. Each air hole 70 is arranged to be in communication with a space radially outside of the air blowing portion 40 through the axial gap(s) 400 adjacent to the flat plate 410 including the air hole 70 on the upper and/or lower sides of the flat plate 410. Each air hole 70 is arranged at a position overlapping with the air inlet 202 of the housing 20 when viewed in the axial direction.

The bottom flat plate 412 is an annular and plate-shaped member centered on the central axis 9. The bottom flat plate 412 has a central hole 75 arranged to pass therethrough in the vertical direction in a center thereof.

Referring to FIG. 4, each spacer 420 is a member in the shape of a circular ring. The spacers 420 are arranged between the flat plates 410 to secure the axial gaps 400 between the flat plates 410. Each spacer 420 has a central hole 429 arranged to pass therethrough in the vertical direction in a center thereof. The motor portion 30 is arranged in the central holes 75 of the flat plates 410 and the central holes 429 of the spacers 420.

Each spacer 420 is arranged at a position axially coinciding with the inner annular portion 71 of each of the top flat plate 411 and the intermediate flat plates 413. Thus, the spacer 420 is arranged in a region in the corresponding axial gap 400, the region covering only a portion of the radial extent of the corresponding axial gap 400. Notice that, in this blower apparatus 1, one of the spacers 420 is arranged on an upper side of the top flat plate 411.

The clamper portion 50 includes a cover portion 51 and a clamping portion 52.

The cover portion 51 is a member in the shape of a disk. The cover portion 51 is arranged to cover an upper side of the motor portion 30 and an upper side of a portion of the radial extent of the air blowing portion 40. That is, at least a portion of the cover portion 51 is arranged on the upper side of the air blowing portion 40. In addition, the cover portion 51 includes a fitting hole 510 at a position overlapping with the central axis 9.

The cover portion 51 includes a central portion 511 arranged most radially inward, a first annular portion 512 arranged radially outside of the central portion 511, and a second annular portion 513 arranged radially outside of the first annular portion 512. A lower surface of the central portion 511 is arranged along the upper surface of the first top plate portion 611 of the hub body member 61 of the hub 322. A lower surface of the first annular portion 512 is arranged along an upper surface of the second top plate portion 622 of the flange member 62. A lower surface of the second annular portion 513 is arranged along an upper surface of the spacer 420 that is arranged at the highest position in the air blowing portion 40.

The lower surface of the first annular portion 512 is arranged at a level higher than that of the lower surface of the central portion 511 and that of the lower surface of the second annular portion 513. Thus, the lower surface of the cover portion 51 includes a recessed portion 514 recessed upward axially above the second top plate portion 622 within a radial range of the first annular portion 512. Then, the second top plate portion 622 is arranged in the recessed portion 514. With the cover portion 51 including the recessed portion 514 in which the second top plate portion 622 is arranged as described above, the axial thickness of the clamper portion 50 is minimized. This contributes to reducing the axial dimension of the blower apparatus 1 and the weight of the blower apparatus 1.

The clamping portion 52 is inserted into the fitting hole 510 of the cover portion 51 and the fixing hole 610 of the hub body member 61 of the hub 322. As a result, the clamping portion 52 fixes the cover portion 51 and the hub body member 61 to each other. That, is, the clamping portion 52 is arranged to fix the cover portion 51 and the motor portion 30 to each other. In addition, the shaft 321 of the motor portion 30 and the clamping portion 52 are arranged axially opposite to each other with a gap therebetween inside of the first cylindrical portion 612 of the hub body member 61.

With the above arrangement, the air blowing portion 40 is held by the flat plate holding portion 623 of the flange member 62 of the hub 322 and the second annular portion 513 of the cover portion 51 from the upper and lower sides in the axial direction. That is, the air blowing portion 40 is held by the motor portion 30 and the clamper portion 50 from the upper and lower sides in the axial direction. With the air blowing portion 40 being thus held and fixed from the upper and lower sides, the air blowing portion 40 and the motor portion 30 can be securely fixed to each other. As a result, the air blowing portion 40 is able to stably rotate, achieving an improvement in air blowing efficiency of the blower apparatus 1.

In this blower apparatus 1, the cover portion 51 includes a plurality of hole portions 515 each of which is arranged to pass therethrough in the axial direction. More specifically, six of the hole portions 515 are defined in the first annular portion 512. In addition, six of the hole portions 515 are defined in the second annular portion 513. As a result, the weight of the cover portion 51 is reduced. Thus, an additional reduction in the weight of the blower apparatus 1 is achieved. Note that the cover portion 51 may be arranged to include recess portions each of which is recessed from an upper surface thereof in place of the hole portions 515. Even in this case, a reduction in the weight of the cover portion 51 can be achieved.

Referring to FIG. 5, the second annular portion 513, which includes an outer end portion of the cover portion 51, defines a flange holding portion arranged radially outside of the recessed portion 514 and the second top plate portion 622, and arranged to radially overlap with the second top plate portion 622. With the second annular portion 513 being arranged to radially overlap with the second top plate portion 622, durability of a rotating body including the rotating portion 32 of the motor portion 30, the air blowing portion 40, and the clamper portion 50 is improved.

Once the motor portion 30 is driven, the air blowing portion 40 and the clamper portion 50 are caused to rotate together with the rotating portion 32. As a result, viscous drag of a surface of each flat plate 410 and a centrifugal force together generate an air flow traveling radially outward in the vicinity of the surface of the flat plate 410. Thus, an air flow traveling radially outward is generated in each of the axial gaps 400 between the flat plates 410. Thus, gas above the housing 20 is supplied to each axial gap 400 through the air inlet 202 of the housing 20 and the air holes 70 of the top flat plate 411 and the intermediate flat plates 413, and is discharged out of the blower apparatus 1 through the air outlet 201, which is defined in a side portion of the housing 20.

Here, each flat plate 410 is arranged to have an axial thickness of about 0.1 mm. Meanwhile, each axial gap 400 is arranged to have an axial dimension of about 0.3 mm. The axial dimension of the axial gap 400 is preferably in the range of 0.2 mm to 0.5 mm. An excessively large axial dimension of the axial gap 400 would lead to a separation between an air flow generated by a lower surface of the flat plate 410 on the upper side and an air flow generated by an upper surface of the flat plate 410 on the lower side during rotation of the air blowing portion 40. This separation could result in a failure to generate sufficient, static pressure in the axial gap 400 to discharge a sufficient volume of air. Moreover, an excessively large axial dimension of the axial gap 400 would make it difficult to reduce the axial dimension of the blower apparatus 1. Accordingly, in this blower apparatus 1, the axial dimension of the axial gap 400 is arranged to be in the range of 0.2 mm to 0.5 mm. This arrangement allows the blower apparatus 1 to achieve a reduced thickness while allowing an increase in the static pressure in the axial gap 400 to discharge a sufficient volume of air.

Each of the fop flat plate 411 and the intermediate flat plates 413 includes the air holes 70. Accordingly, in each of the top flat plate 411 and the intermediate flat plates 413, the outer annular portion 72, which is arranged radially outside of the air holes 70, defines an air blowing region which generates an air flow in the vicinity of a surface thereof. Meanwhile, the bottom flat plate 412 includes no air hole 70. Therefore, in an upper surface of the bottom flat plate 412, an entire region radially outside of a portion of the bottom flat plate 412 which makes contact with the spacer 420 defines an air blowing region. In other words, in the upper surface of the bottom flat plate 412, a region which axially coincides with the air holes 70 and the ribs 73 of the top flat plate 411 and the intermediate flat plates 413, and a region which axially coincides with the outer annular portions 72 thereof, together define the air blowing region. In addition, in a lower surface of the bottom flat plate 412, an entire region radially outside of a portion of the bottom flat plate 412 which makes contact with the flat plate holding portion 623 defines an air blowing region. Notice that an air flow is generated by a lower surface of the flat plate holding portion 623 as well.

As described above, the bottom flat plate 412 has air blowing regions wider than the air blowing regions of the top flat plate 411 and the intermediate flat plates 413. Therefore, the axial gap 400 between the lowest one of the intermediate flat plates 413 and the bottom flat plate 412 is able to have higher static pressure than any other axial gap 400.

Air flows passing downward through the air inlet 202 and the air holes 70 are drawn radially outward in each axial gap 400. Therefore, the air flows passing through the air holes 70 become weaker as they travel downward. In the present preferred embodiment, the bottom flat plate 412 is arranged to have an air blowing region wider than the air blowing regions of the top flat plate 411 and the intermediate flat plates 413 to cause a stronger air flow to be generated in the lowest one of the axial gaps 400 than in any other axial gap 400 to cause the air flows passing downward through the air holes 70 to be drawn toward the lowest axial gap 400. Thus, a sufficient volume of gas is supplied to the lowest axial gap 400 as well. As a result, the air blowing portion 40 achieves improved air blowing efficiency.

In a related-art blower apparatus that generates air flows by rotating an impeller including a plurality of blades, air flows generated by the impeller leak at upper and lower end portions of the impeller. This leakage of the air flows occurs regardless of the axial dimension of the blower apparatus. Therefore, as the blower apparatus is designed to be thinner, an effect, of this leakage on the blower apparatus as a whole becomes greater, resulting in lower air blowing efficiency. Meanwhile, in the blower apparatus 1 according to the present preferred embodiment, the air flows are generated in the vicinity of the surfaces of the flat plates 410, and therefore, the air flows do not easily leak upward or downward. Therefore, even when the axial dimension of the air blowing portion 40, which generates the air flows, is reduced, a reduction in air blowing efficiency due to leakages of the air flows does not easily occur. That is, even when the blower apparatus 1 has a reduced thickness, a reduction in air blowing efficiency thereof does not easily occur.

In addition, in a blower apparatus including an impeller, periodic noise occurs owing to the shape, number, arrangement, and so on of blades. However, this blower apparatus 1 is superior to a comparable blower apparatus including an impeller in terms of being silent, because the air flows are generated by the viscous drag of the surface of each flat plate 410 and the centrifugal force in the blower apparatus 1.

In addition, from the viewpoint of P-Q characteristics (i.e., flow rate-static pressure characteristics), the blower apparatus 1 including the flat plates 410 is able to produce a higher static pressure in a low flow rate region than the blower apparatus including the impeller. Therefore, when compared to the blower apparatus including the impeller, the blower apparatus 1 is suitable for use in a densely packed case, from which only a relatively small volume of air can be discharged. Examples of such cases include cases of electronic devices, such as, for example, personal computers.

In the present preferred embodiment, the top flat plate 411 and all the intermediate flat plates 413 include the air holes 70. Accordingly, all the axial gaps 400 are in axial communication with a space above the housing 20 through the air inlet 202 and the air holes 70.

Referring to FIG. 2, the air inlet 202 is centered on the central axis 9. That is, a center of the air inlet 202 coincides with the central axis 9. Meanwhile, the air blowing portion 40 is also centered on the central axis 9. Accordingly, differences in pressure do not easily occur at different circumferential positions in the air blowing portion 40. This contributes to reducing noise. It is assumed that the term "coincide" as used here includes not only "completely coincide" but also "substantially coincide".

2. Example Modifications

While a preferred embodiment of the present invention has been described above, it is to be understood that the present invention is not limited to the above-described preferred embodiment.

Figure 6:
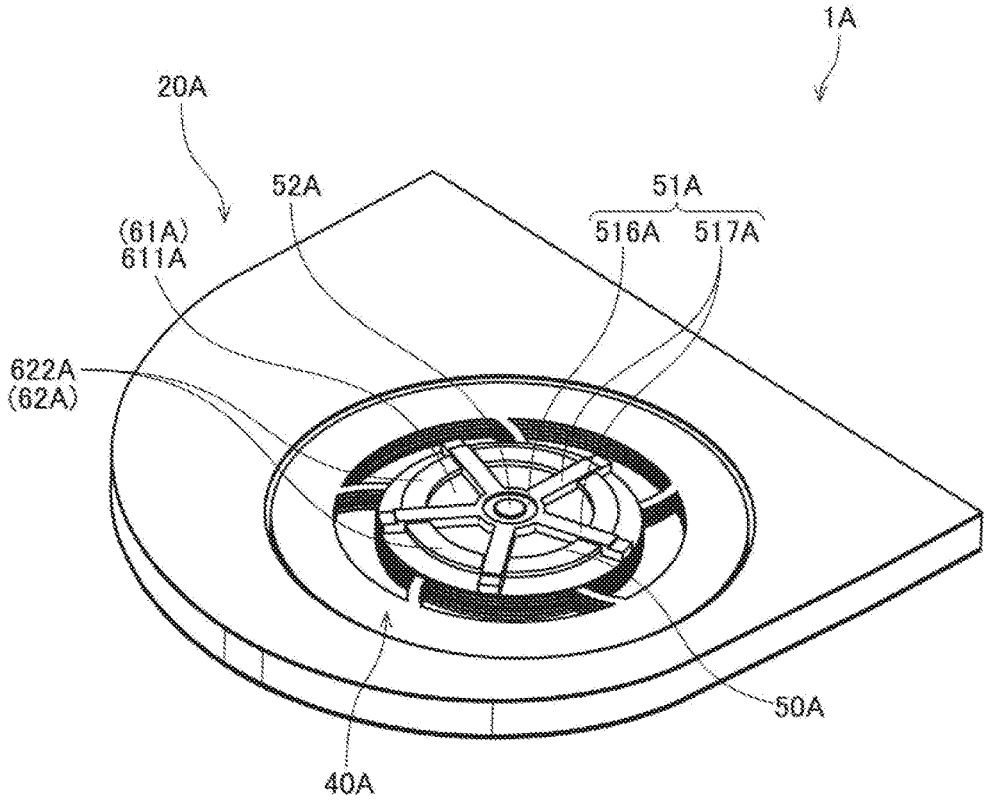
FIG. 6 is a perspective view of a blower apparatus according to a modification of the first preferred embodiment.
Figure 7:
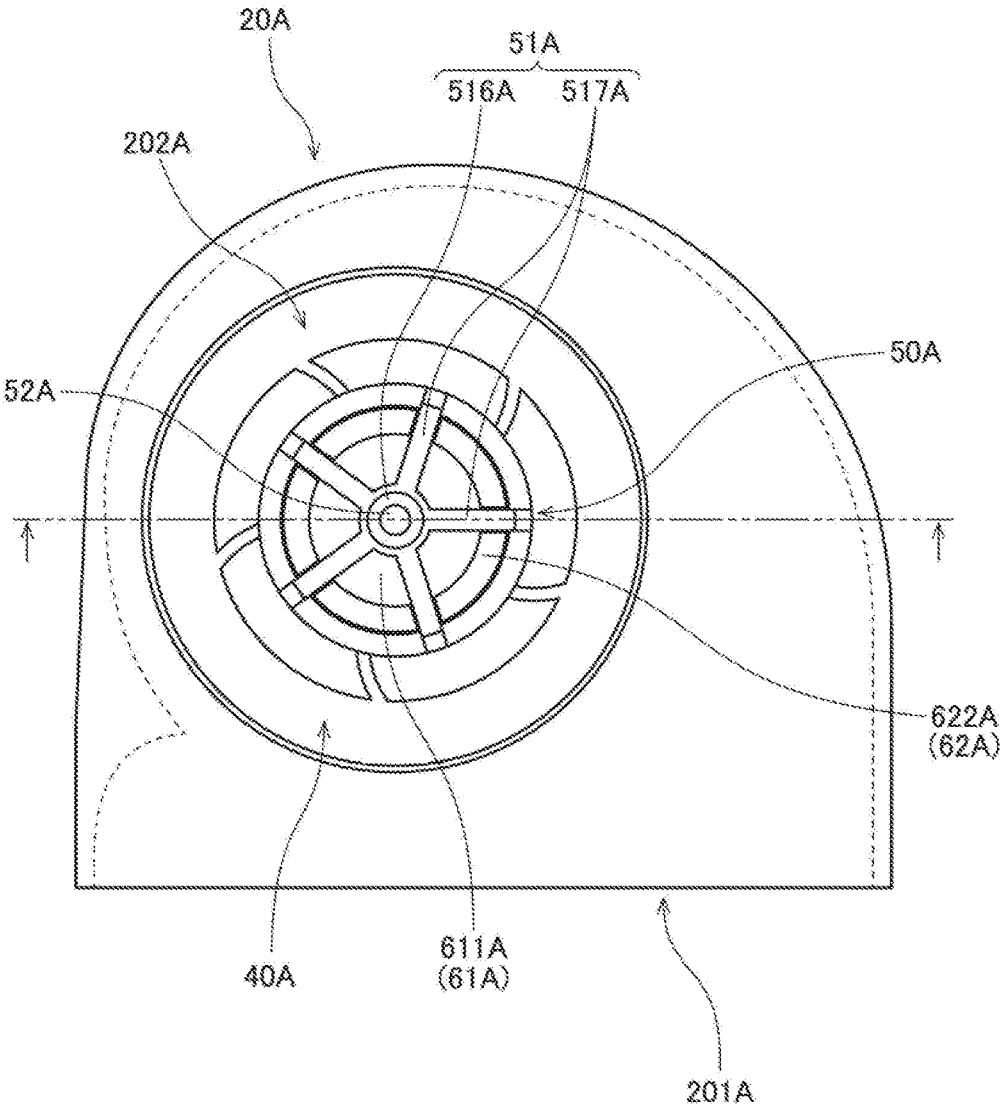
FIG. 7 is a top view of the blower apparatus according to a modification of the first preferred embodiment.
Figure 8:
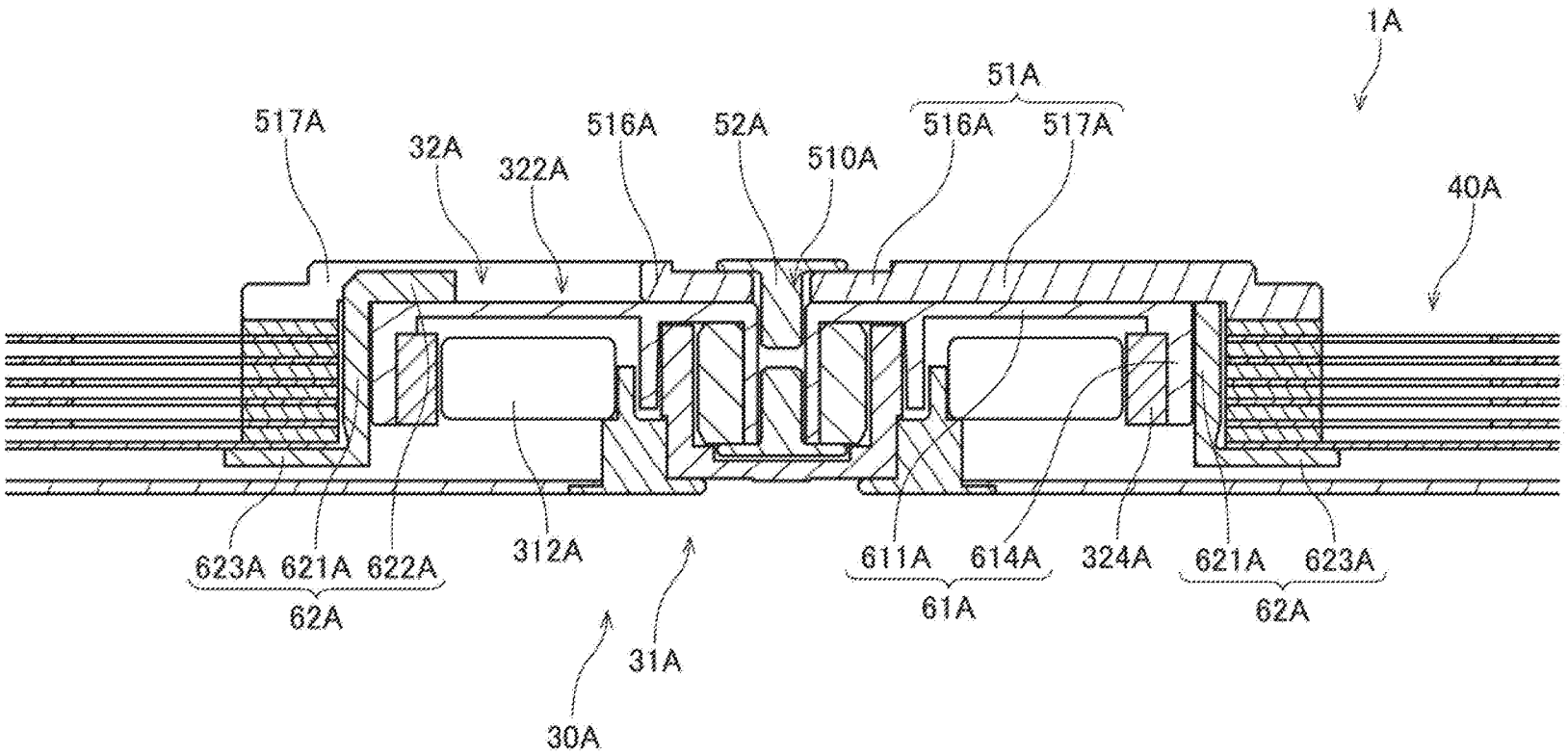
FIG. 8 is a partial sectional view of the blower apparatus according to a modification of the first preferred embodiment.

FIG. 6 is a perspective view of a blower apparatus 1A according to a modification of the above-described preferred embodiment. FIG. 7 is a top view of the blower apparatus 1A according to the modification illustrated in FIG. 6. FIG. 8 is a partial sectional view of the blower apparatus 1A according to the modification illustrated in FIG. 6. The blower apparatus 1A according to the modification illustrated in FIGS. 6 to 8 includes a motor portion 30A, an air blowing portion 40A, and a clamper portion 50A. The motor portion 30A includes a stationary portion 31A and a rotating portion 32A. The stationary portion 31A includes a stator 312A, which is an armature. The rotating portion 32A includes a magnet 324A arranged radially outside of the stator 312A, and a hub 322A arranged to hold the magnet 324A.

The hub 322A is made up of a hub body member 61A and a flange member 62A. The hub body me miser 61A includes a first top plate portion 611A and a magnet holding portion 614A. The first top plate portion 611A is arranged to cover an upper side of the stator 312A. The magnet holding portion 614A is arranged to hold the magnet 324A with an inner circumferential surface thereof. The flange member 62A includes an outer wall portion 621A, second top plate portions 622A, and a flat plate holding portion 623A. The flat plate holding portion 623A is arranged to hold the air blowing portion 40A on a radially outer side of the magnet holding portion 614A. The outer wall portion 621A is arranged to extend upward from the flat plate holding portion 623A along an outer circumferential surface of the magnet holding portion 614A. Each second top plate portion 622A is arranged to extend radially inward from an upper end of the outer wall portion 621A, and is arranged along an upper surface of the first top plate portion 611A.

The clamper portion 50A includes a cover portion 51A and a clamping portion 52A. The cover portion 51A includes a center portion 516A including a fitting hole 510A, and a plurality of arm portions 517A arranged to extend in a radial manner from the center portion 516A. At least a portion of each arm portion 517A is arranged on the upper side of the air blowing portion 40A. Thus, the air blowing portion 40A is held by the flat plate holding portion 623A of the motor portion 30A and the arm portions 517A of the clamper portion 50A from the upper and lower sides in the axial direction. The air blowing portion 40A and the motor portion 30A are thus securely fixed to each other. With the cover portion 51A being defined by the center portion 516A and the arm portions 517A as described above, a reduction in volume of the cover portion 51A is achieved. Accordingly, a reduction in weight of the blower apparatus 1A is achieved.

In this blower apparatus 1A, the second top plate portions 622A are spaced from one another in the circumferential direction. On the upper surface of the first top plate portion 611A, the second top plate portions 622A and the arm portions 517A of the cover portion 51A are arranged to alternate with each other in the circumferential direction. That is, each second top plate portion 622A is arranged between circumferentially adjacent ones of the arm portions 517A. In addition, referring to FIG. 8, an axial position of each second top plate portion 622A and an axial position of each arm portion 517A are arranged to overlap with each other. This arrangement enables the blower apparatus 1A to have a smaller axial dimension than in a case where the cover portion 51A of the clamper portion 50A is arranged on the upper side of the second top plate portions 622A. Thus, a reduction in thickness of the blower apparatus 1A can be achieved.

Figure 9:
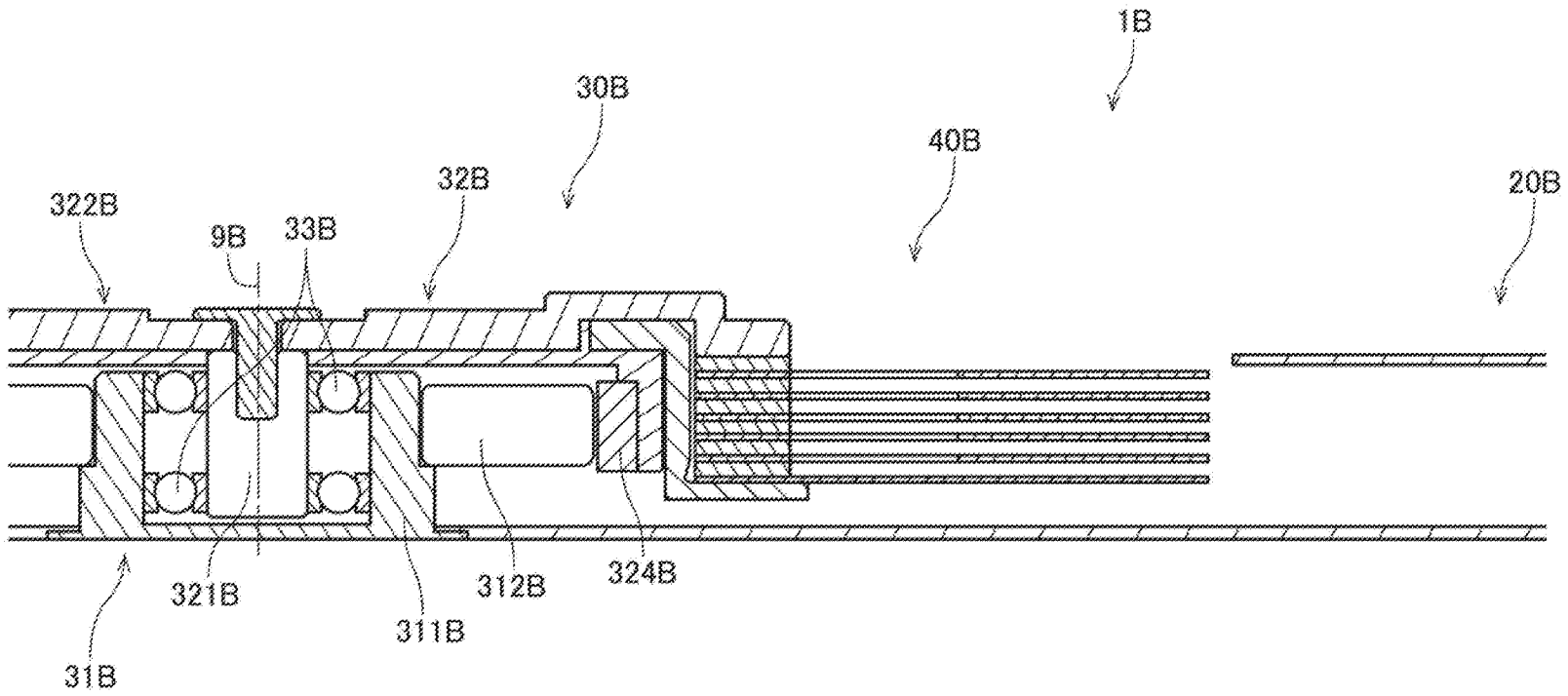
FIG. 9 is a partial sectional view of a blower apparatus according to a modification of the first preferred embodiment.

FIG. 9 is a partial sectional view of a blower apparatus 1B according to another modification of the above-described preferred embodiment. In the blower apparatus 1B according to the modification illustrated in FIG. 9, a motor portion 30B includes a stationary portion 31B, a rotating portion 32B, and two ball bearings 33B.

The stationary portion 31B includes a stator fixing portion 311B and a stator 312B. The stator fixing portion 311B is a member being cylindrical and having a closed bottom and fixed to a housing 20B. The stator 312B is an armature fixed to an outer circumferential surface of the stator fixing portion 311B.

The rotating portion 32B includes a shaft 321B, a hub 322B, and a magnet 324B. At least a lower end portion of the shaft 321B is arranged inside of the stator fixing portion 311B. In addition, an upper end portion of the shaft 321B is fixed to the hub 322B. The magnet 324B is fixed to the hub 322B. The magnet 324B is arranged radially opposite to the stator 312B.

Each ball bearing 33B is arranged to connect the rotating portion 32B to the stationary portion 31B such that the rotating portion 32B is rotatable with respect to the stationary portion 31B. Specifically, an outer race of each ball bearing 33B is fixed to an inner circumferential surface of the stator fixing portion 311B of the stationary portion 31B. In addition, an inner race of each ball bearing 33B is fixed to an outer circumferential surface of the shaft 321B of the rotating portion 32B. Further, a plurality of balls, each of which is a spherical roll element, are arranged between the outer race and the inner race. As described above, instead of a fluid dynamic bearing, rolling-element bearings, such as, for example, ball bearings, may be used as a bearing structure of the motor portion 30B.

In the modification illustrated in FIG. 9, the motor portion 30B includes the two ball bearings 33B. The ball bearings 33B are arranged near an upper end and a lower end of an axial range over which the inner circumferential surface of the stator fixing portion 311B and the shaft 321B are opposed to each other. This contributes to preventing the shaft 321B from being inclined with respect to a central axis 9B.

Figure 10:
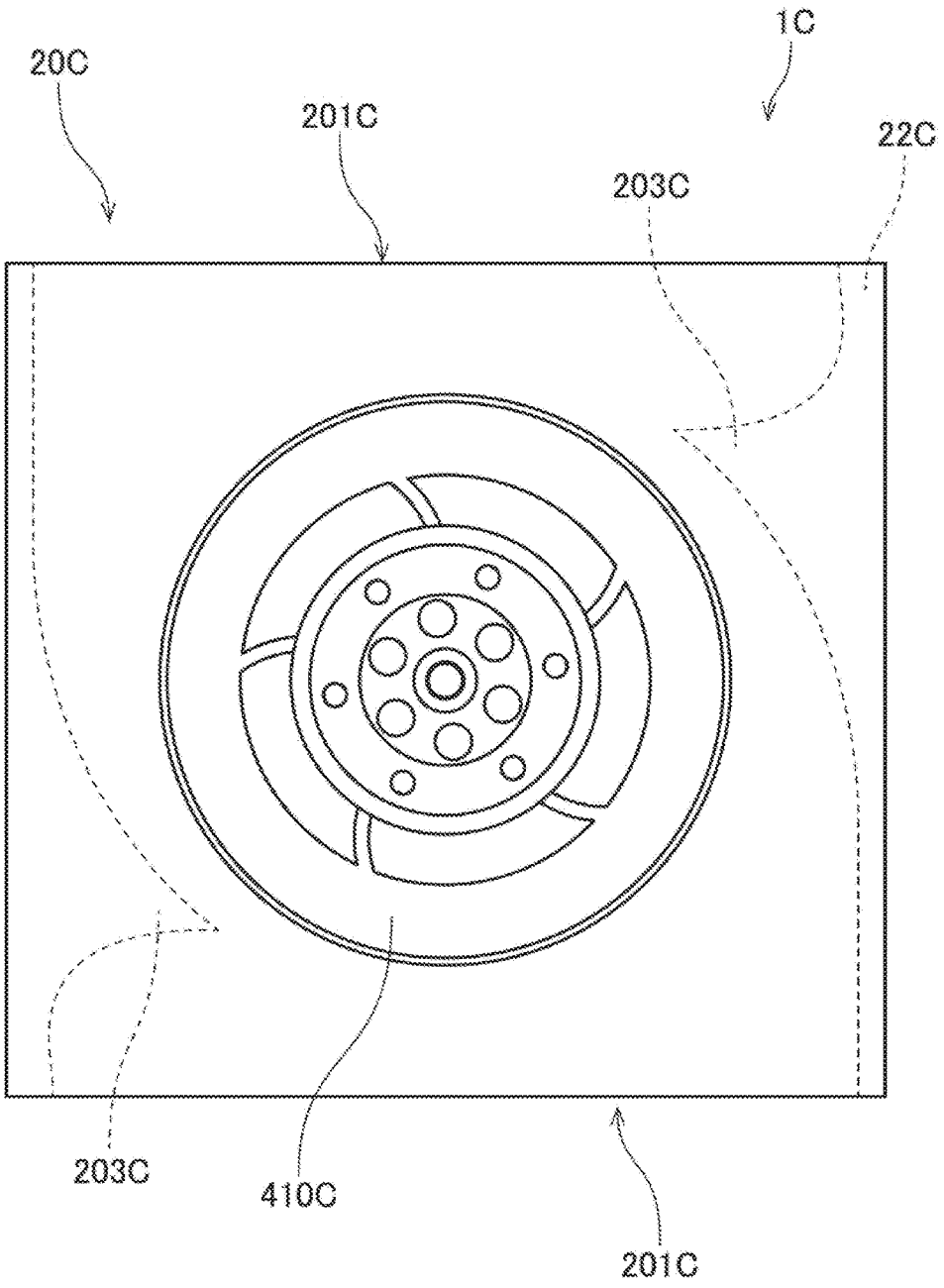
FIG. 10 is a top view of a blower apparatus according to a modification of the first preferred embodiment.

FIG. 10 is a top view of a blower apparatus 1C according to yet another modification of the above-described preferred embodiment. In the blower apparatus 1C according to the modification illustrated in FIG. 10, a housing 20C includes a plurality of air outlets 201C. Specifically, a side wall portion 22C includes the air outlets 201C, each of which is arranged to face in a radial direction, at a plurality of circumferential positions. The housing 20C includes tongue portions 203C, each of which is arranged near a separate one of the air outlets 201C. In addition, an air blowing portion 40C includes a plurality of flat plates 410C arranged in the axial direction with an axial gap defined between adjacent ones of the flat plates 410C.

In a centrifugal fan including an impeller, periodic noise occurs owing to the shape, number, arrangement, and so on of blades. In addition, such noise tends to easily occur around a tongue portion. Accordingly, when air is to be discharged in a plurality of directions, a deterioration in noise characteristics occurs because of an increased number of tongue portions. However, in this blower apparatus 1C, air flows traveling radially outward are generated by rotation of the flat plates 410C, and therefore, the blower apparatus 1C is able to achieve reduced periodic noise when compared to the centrifugal fan including the impeller. Therefore, the blower apparatus 1C, which is designed to discharge air in a plurality of directions, does not significantly deteriorate in noise characteristics due to the tongue portions 203C.

Note that, although the number of flat plates included in the air blowing portion is six in each of the above-described preferred embodiment and the modifications thereof, this is not essential to the present invention. The number of flat plates may alternatively be two, three, four, five, or more than six.

Also note that, although the hub is defined by two members, i.e., the hub body member and the flange member, in each of the above-described preferred embodiment and the modifications thereof, this is not essential to the present invention. The hub may alternatively be defined by a single member, or three or more members.

Also note that the detailed shape of any member may be different from the shape thereof as illustrated in the accompanying drawings of the present application. For example, the shape of any of the housing, the air blowing portion, and the motor portion may be different from that according to each of the above-described preferred embodiment and the modifications thereof. Also note that features of the above-described preferred embodiment and the modifications thereof may be combined appropriately as long as no conflict arises.

Preferred embodiments of the present invention are applicable to blower apparatuses.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A blower apparatus comprising:

an air blowing portion arranged to rotate about a central axis extending in a vertical direction;

a motor portion arranged to rotate the air blowing portion, and having at least a portion thereof arranged on a lower side of the air blowing portion;

a clamper portion which is rotatable with respect to the stationary portion fixed to the motor portion, and having at least a portion thereof arranged on an upper side of the air blowing portion; and a housing arranged to house the air blowing portion and the motor portion; wherein the housing includes:

an air inlet arranged above the air blowing portion, and arranged to pass through a portion of the housing in an axial direction; and an air outlet arranged to face in a radial direction at at least one circumferential position radially outside of the air blowing portion;

the air blowing portion includes a plurality of flat plates arranged in the axial direction with an axial gap defined between adjacent ones of the flat plates; and the air blowing portion is held by the motor portion and the clamper portion from upper and lower sides in the axial direction, wherein the clamper portion includes:

a cover portion including a fitting hole at a position overlapping with the central axis, and having at least a portion thereof arranged on the upper side of the air blowing portion; and a clamping portion inserted into the fitting hole to fix the cover portion and the motor portion to each other;

wherein the motor portion includes:

a stationary portion including an armature; and a rotating portion including a magnet arranged radially outside of the armature, and a hub arranged to hold the magnet; and the cover portion includes:

a center portion including the fitting hole; and a plurality of arm portions arranged to extend in a radial manner from the center portion, each arm portion having at least a portion thereof arranged on the upper side of the air blowing portion.

2. The blower apparatus according to claim 1 wherein the cover portion includes a recess portion recessed from an upper surface thereof or a hole portion arranged to pass therethrough in the axial direction.

3. The blower apparatus according to claim 1, wherein the motor portion includes:

a stationary portion including an armature; and a rotating portion including a magnet arranged radially outside of the armature, and a hub arranged to hold the magnet;

the hub includes:

a hub body member including a first top plate portion arranged to cover an upper side of the armature, and a magnet holding portion arranged to hold the magnet with an inner circumferential surface thereof; and a flange member including a second top plate portion arranged to cover a portion of an upper surface of the hub body member, and a flat plate holding portion arranged to hold the air blowing portion on a radially outer side of the magnet holding portion;

a lower surface of the cover portion includes a recessed portion recessed upward axially above the second top plate portion; and the second top plate portion is arranged in the recessed portion.

4. The blower apparatus according to claim 3, wherein the cover portion includes a flange holding portion arranged radially outside of the recessed portion and the second top plate portion, and arranged to radially overlap with the second top plate portion.

5. The blower apparatus according to claim 1, wherein the hub includes:

a hub body member including a first top plate portion arranged to cover an upper side of the armature, and a magnet holding portion arranged to hold the magnet with an inner circumferential surface thereof; and a flange member including a flat plate holding portion arranged to hold the air blowing portion on a radially outer side of the magnet holding portion, an outer wall portion arranged to extend upward from the flat plate holding portion along an outer circumferential surface of the magnet holding portion, and second top plate portions each of which is arranged to extend radially inward from an upper end of the outer wall portion, and is arranged along an upper surface of the first top plate portion; and on the upper surface of the first top plate portion, the second top plate portions and the arm portions are arranged to alternate with each other in a circumferential direction.

6. The blower apparatus according to claim 1, wherein the motor portion includes:

a stationary portion including an armature; and a rotating portion including a magnet arranged radially outside of the armature, a hub arranged to hold the magnet, and a shaft arranged to extend along the central axis; and the shaft and the clamping portion are arranged axially opposite to each other with a gap therebetween.

7. The blower apparatus according to claim 1, wherein a center of the air inlet is arranged to coincide with the central axis.

8. The blower apparatus according to claim 1, wherein the motor portion includes:

a stationary portion including an armature and a bearing housing; and a rotating portion including a shaft, a bearing member, and a magnet arranged radially opposite to the armature;

the bearing housing and a combination of the shaft and the bearing member are arranged to have a lubricating fluid therebetween;

the bearing housing and the rotating portion are arranged to together define a gap defining a seal portion therebetween, the seal portion having a surface of the lubricating fluid defined therein; and in the seal portion, a distance between the bearing housing and the rotating portion is arranged to increase with increasing distance from the surface of the lubricating fluid.

9. The blower apparatus according to claim 1, wherein the motor portion includes:

a stationary portion including an armature and a bearing housing;

a rotating portion including a shaft and a magnet arranged radially opposite to the armature; and a ball bearing arranged to connect the rotating portion to the stationary portion such that the rotating portion is rotatable with respect to the stationary portion.

10. The blower apparatus according to claim 1, wherein the housing includes a plurality of the air outlets at a plurality of circumferential positions.

* * * * *